United States Patent [19]

Genese

[11] 4,161,178

[45] Jul. 17, 1979

[54] ADDITIVE TRANSFER DEVICE

[75] Inventor: Joseph N. Genese, Waukegan, Ill.

[73] Assignee: Abbott Laboratories, North Chicago, Ill.

[21] Appl. No.: 858,493

[22] Filed: Dec. 8, 1977

[51] Int. Cl.[2] ..... A61J 1/00

[52] U.S. Cl. ..... 128/272.3; 141/329

[58] Field of Search ..... 128/272.3, 272, 218 M, 128/218 R, 232; 141/329

[56] References Cited

U.S. PATENT DOCUMENTS

| | | | |
|---|---|---|---|
| 3,158,155 | 11/1964 | Myerson et al. | 128/272 X |
| 3,788,369 | 1/1974 | Killinger | 128/272.3 X |
| 3,826,260 | 7/1974 | Killinger | 128/272 |
| 3,844,284 | 10/1974 | Schoenfeld et al. | 128/232 |
| 3,872,867 | 3/1975 | Killinger | 128/272 X |
| 3,987,791 | 10/1976 | Chittenden et al. | 128/272.3 |
| 4,059,112 | 11/1977 | Tischlinger | 128/272.3 |

FOREIGN PATENT DOCUMENTS

| | | | |
|---|---|---|---|
| 1456517 | 11/1976 | United Kingdom | 128/272.3 |

*Primary Examiner*—Robert E. Bagwill
*Attorney, Agent, or Firm*—Robert L. Niblack; Neil E. Hamilton

[57] ABSTRACT

An additive transfer device for storing and transferring of a medicament to a solution container such as an I.V. bag having an exposed port. The transfer device is accommodated in the neck of an additive container having a pierceable sealing element. A holder member for a doubled pointed end piercing member engages a cap covering the tubular neck and affords a movement of the piercing member toward the sealing element to pierce it. Guide means extend from the holder member and fit over the tubular port of the I.V. bag. When the opposing pointed end of the piercing element is pierced through the I.V. port, communication can be made between the additive container and the I.V. bag. In a preferred manner, the contents of the additive container are expelled by collapsing the walls which force the medicament into the I.V. bag by means of the piercing element.

14 Claims, 5 Drawing Figures

ADDITIVE TRANSFER DEVICE

BACKGROUND OF THE INVENTION

This invention relates to a device for storing and transferring a medicament to a flexible container such as an I.V. bag. More particularly, the invention relates to an additive transfer device wherein a holder member for a piercing member is orientated and carried into a cap of an additive container of the collapsible type to afford a piercing through a sealing element held between the cap and the container neck.

Additive transfer units of the type concerned with in this invention are described in U.S. Pat. Nos. 3,033,202; 3,788,369; 3,826,260; 3,828,779; 3,938,520 as well as 3,987,791. Many of the units described in these patents, for example in Nos. 3,033,202; 3,938,520 and 3,987,791, are not specifically directed to a device for making an addition to a flexible I.V. bag. In the instance of U.S. Pat. Nos. 3,788,369 and 3,838,779 which are so directed, a specially designed closure for a vial or a large, multi-component device is indicated as well as in U.S. Pat. No. 3,826,260. The prior art nowhere provides a simplified and compact transfer unit for making additions to an I.V. flexible container. In particular, the prior art does not provide a simplified additive device for use with an I.V. bag wherein a container cap serves as a means to secure a pierceable diaphragm in the neck of an additive container and also afford alignment and movement of a hollow piercing member to cause the piercing member to pierce through the diaphragm seal in the neck of a container and afford communication between the additive container and the I.V. bag. The opposing end of the piercing cannula is then inserted through the bag port and the contents of the container expelled by collapsing the container wall.

It is an advantage of the present invention to afford a novel additive transfer device which is specifically adapted for use with a flexible I.V. container. Other advantages are an additive transfer unit which can be employed with a small volume, collapsible container; utilizes a minimum number of parts and a minimum number of interfitting components; can be activated in a fast manner while having one of the components serve multiple functions.

SUMMARY OF THE INVENTION

The foregoing advantages are accomplished and the shortcomings of the prior art are overcome by the present additive transfer unit which is employed with an additive container having a flexible wall. A pierceable diaphragm seals an opening in the neck of the container and is preferably retained therein by means of a cap for the container. A holder member is integrally fixed to a piercing member and carries the piercing member toward the pierceable diaphragm. Guide means extend from the holder member for surrounding an exposed, pierceable closure of an I.V. flexible bag. Activating means is preferably provided by a threaded engagement of the holder member in the container cap so that upon movement of the holder toward the cap, one end of the piercing member will pierce through the diaphragm seal in the container neck. A cover extending over the holder and enclosing the guide means will be removed and the end of the piercing member adjacent the guide means will be inserted through the bag port. The contents of the additive container can then be forced into the bag by collapsing the wall or walls of the additive container. In a preferred manner, the pierceable diaphragm is in the form of a disc member held captive by the container cap at the end of the neck and the cap is internally threaded to receive the external threads of the holder which are in the form of a projecting stem for engaging the container cap.

BRIEF DESCRIPTION OF DRAWING

A better understanding of the additive transfer unit of this invention will be afforded by reference to the drawing wherein.

DESCRIPTION OF THE EMBODIMENT

Figure 1:
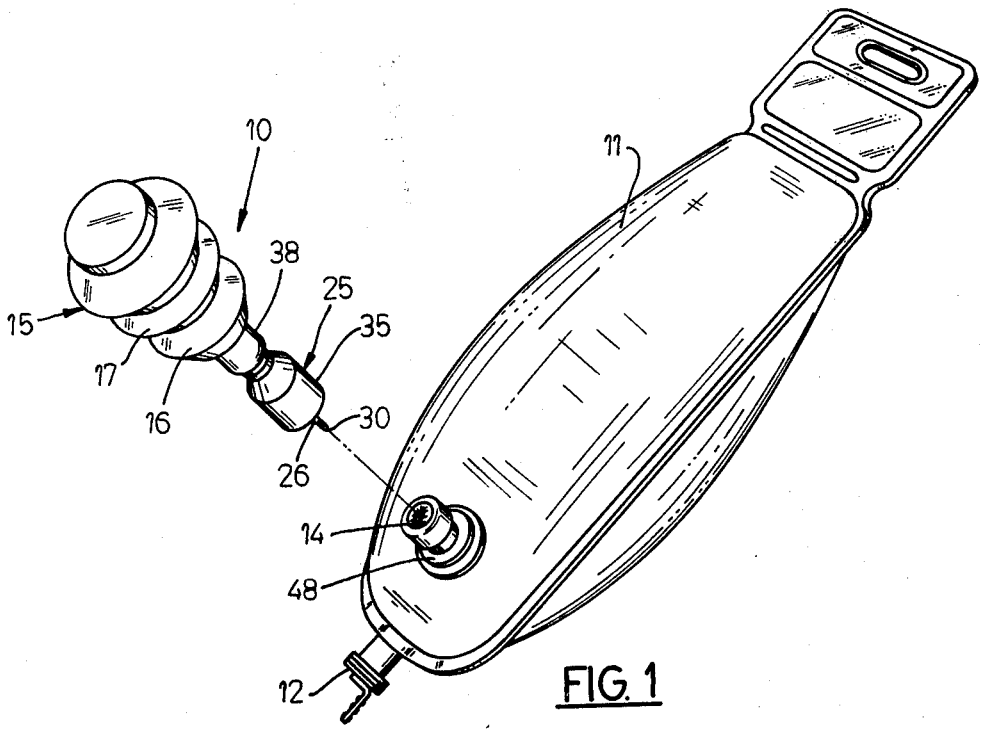
FIG. 1 is a perspective view of the additive transfer device and an I.V. flexible bag with the transfer unit orientated with the additive port of the bag.

Proceeding to a detailed description of one embodiment of the invention, the additive transfer unit 10, as shown in FIG. 1, is illustrated in orientation with a solution container in the form of an I.V. bag 11. Bag 11 is of the type described in U.S. Pat. No. 3,915,212 entitled "Flexible Medicinal Fluid Container Having a Combined Fill Administration Port and Reinforced Hanger" and is commonly assigned. It has the usual protruding additive port 14 in the form of a pierceable closure and an administration port 12. Transfer device 10 includes an additive container 15 of the kind described in U.S. Pat. No. 3,844,284 entitled "Disposable Douche" except that in place of the nozzle, a holder member 25 with a guide 35 is provided to surround the pierceable closure 14 on I.V. bag 11. Container 15 is of the collapsible type and includes a series of collapsible walls such as 16 and 17.

Figure 2:
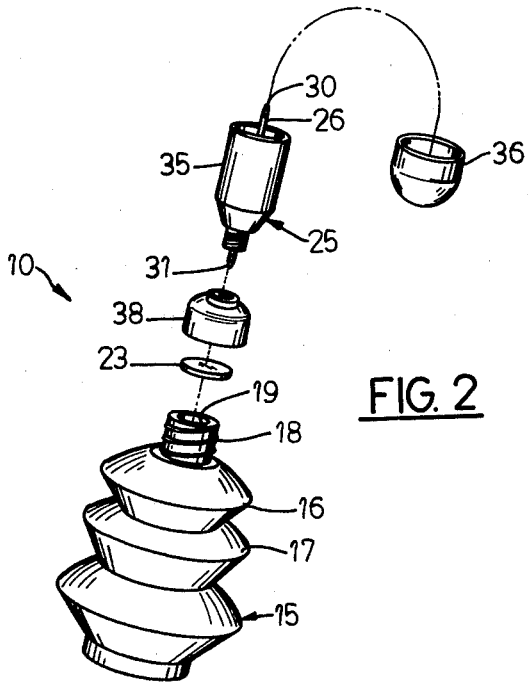
FIG. 2 is an assembly view of the additive transfer unit with the cover member offset from the additive container.
Figure 3:
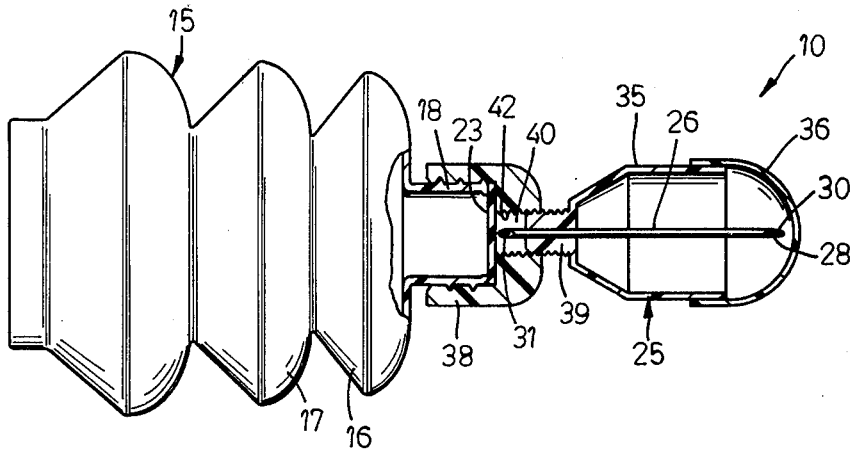
FIG. 3 is a view in side elevation of the additive transfer device with a portion broken away to show the piercing member in the inactivated position.

As best seen in FIGS. 2 and 3, additive container 15 has a threaded neck 18 with a pierceable diaphragm 23 seated over the end thereof and held thereon by means of internally threaded cap 38.

Piercing member 26 is integrally secured to holder member 25 by means of externally threaded stem 39. Piercing member 26 has opposing piercing points 30 and 31 and is hollow to provide a channel 28 for the passage of flowable medicament therethrough. A centrally positioned passage 40 is provided in cap 38 and is internally threaded to receive threaded stem 39 which is of a smaller transverse dimension than guide 35. A cover 36 is placed over guide 35 and encloses piercing point 30 extending from guide 35. Guide 35 is a hollow cylindrical portion which is dimensioned to fit loosely around the circular, pierceable closure 14 of bag 11.

Figure 5:
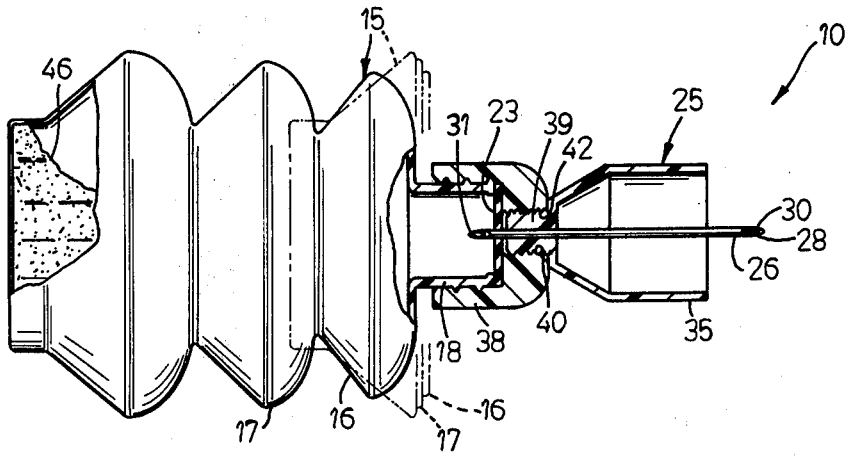
FIG. 5 is a view similar to FIG. 4 except with the cover removed, a portion of the container broken away to show the additive fluid and with the container shown in phantom lines in a completely collapsed condition.

Referring to FIG. 5, it will be noted that container 15 holds a fluid medicament agent 46 which in this instance is a liquid. In order to expel agent 46, container walls 16 and 17 will collapse upon themselves to result in a configuration as shown in phantom lines.

Operation

Figure 4:
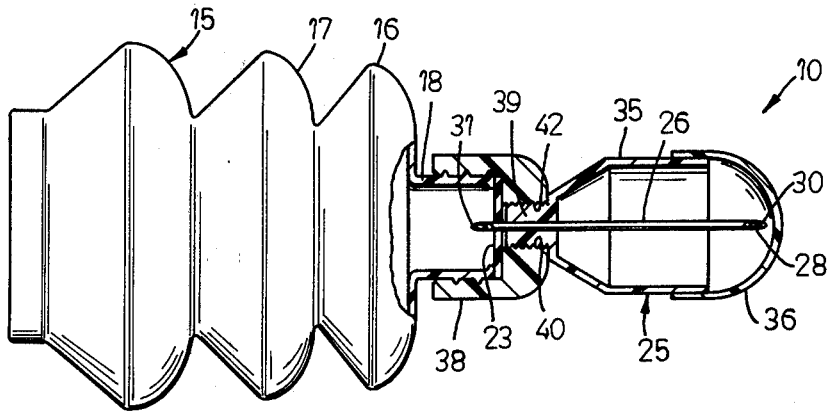
FIG. 4 is a view similar to FIG. 3 showing the additive transfer unit of this invention with the piercing element penetrating through the diaphragm of the additive container.

A better understanding of the advantages of the additive administration device 10 will be had by description of its operation. Additive transfer device 10 will be packaged in a sterile condition and be assembled in the manner indicated in FIG. 2 to result in an assembled unit shown in FIG. 3 with threaded stem 39 partially engaging threads 42 of cap 38 and piercing point 31 spaced from pierceable sealing element 23. When it is desired to utilize the additive transfer unit, a rotating motion will be exerted on holder member 25 and cover 36 such as by grasping between the forefinger and thumb while container 15 is held in a stationary manner. This force will cause stem 39 to move inwardly into cap 38 and cause piercing point 31 to pierce through pierceable sealing element 23 to thereby provide fluid communication with the contents of additive container 15. The transfer device 10 will then appear as in FIG. 4. Cover 36 will then be removed from holder 25 and, in this condition, the additive transfer unit 10 will be ready for insertion through an additive port 14 on flexible I.V. bag 11. To accomplish this, guide 35 will be orientated as indicated in FIG. 1 and ultimately around the outside of additive port 14. It will be moved downwardly thereover until the end surface of guide 35 contacts port annulus 48 adjacent the outside surface of bag 11. As guide 35 is so positioned, piercing point 30 will have pierced through the seal in the additive port 14 to effect fluid communication with the inside of bag 11. In this position, fluid communication will be provided between the inside of I.V. bag 11 and the inside of additive container 15. All that is then required to expel the contents 46 of the additive container 15 into bag 11 is to compress the side walls such as 16 and 17 of container 15 in the normal manner for a pleated collapsible container and assume a position shown in phantom lines in FIG. 5. This will force the medicament agent 46 in container 15 into bag 11. With the removal of the additive unit from the bag, the contents of bag 11 is then ready for normal administration by means of the usual I.V. administration apparatus.

It will be noted that unit 10 is of simplified construction employing a minimum number of parts. Cap 38 serves a dual function in captively holding pierceable diaphragm 23 over the end of container neck 18 while affording a threaded engagement for threaded stem 39. Container 15 has been illustrated as a multiwalled collapsible container. It will be recognized that any container having at least one collapsible wall would function as well.

The foregoing described unit is disposable with the holder member 25 and cap 38 formed of a polypropylene or polyester terephthalate plastic material. Cover 36 is preferably fabricated from polyethylene. The additive container 15, as well as the tubular neck portion 18 can be conveniently composed of an ionomer or ethylene-vinyl acetate plastic material, whereas pierceable diaphragm 23 is formed from butyl rubber. The piercing member 26 is composed of a stainless steel or polycarbonate. Obviously, other materials including plastics which are insert to I.V. liquids and are readily molded could be utilized in place of the indicated material to form the various components.

It will thus be seen that through the present invention there is now provided an additive transfer unit which is simplified in its construction utilizing a minimum number of parts. The units are readily activated in a basic one or two-step operation and are easily mounted over the additive port of an I.V. bag. The additive transfer device is readily molded from standard molding equipment and does not require any special tooling or fabrication techniques.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

I claim:

1. An additive transfer device for storing and transferring of a medicament to a solution container having a pierceable closure comprising:

an additive container for storing the medicament to be transferred, said additive container having at least one collapsible wall and defining a neck portion with an opening therein;

a pierceable diaphragm member sealing the opening in the container;

a closure member secured to said neck portion and in contact with a portion of said diaphragm member, said closure member presenting a passage therethrough;

a holder member;

a piercing member having a channel therethrough for the flow of said medicament and a piercing point on both ends thereof, an intermediate portion of said piercing member secured to said holder member;

guide means defined by said holder member, said guide means positioned from said piercing member and terminating inwardly of one end of said piercing member;

a cover member adapted to extend over said holder member and said one end of said piercing member extending beyond said guide means; and said holder member and said additive container being interconnected to permit movement of said holder member and said piercing member toward said additive container;

so that upon movement of said holder, said piercing member will move in the direction of said pierceable diaphragm through said passage to effect penetration thereof and upon removal of said cover member and penetration of said solution container closure by the other piercing end of said piercing member, the contents of said additive container can be expelled into the solution container by collapsing said wall of said additive container.

2. The additive transfer device of claim 1 wherein said interconnection is defined in part by a complementary threaded engagement carried by said neck portion and said holder.

3. The additive transfer device of claim 2 wherein said closure member is defined by a cap member operatively associated with said neck portion and said threaded engagement carried by said neck portion is defined by said cap member.

4. The additive transfer device as defined in claim 3 wherein said diaphragm member is defined by a disc member captively held between said container cap member and the outer end of said neck portion.

5. The additive transfer device as defined in claim 2 wherein said threaded engagement carried by said holder is defined by a threaded stem portion extending from said guide means, said stem positioned coaxially with and exteriorly of a portion of said piercing member, said stem portion terminating inwardly of an end thereof opposite said one end spaced from said guide means.

6. The additive transfer device as defined in claim 5 wherein said threaded stem portion is of a smaller transverse dimension than said guide means.

7. The additive transfer device as defined in claim 1 wherein said collapsible wall is defined by a multiplicity of collapsible wall portions connected in a serial manner.

8. The additive transfer device as defined in claim 6 wherein all of said components except said piercing member and said pierceable diaphragm are composed of a resinous, plastic material.

9. A ready-to-use, readily activated three component transfer device for storing and transferring of a medicament to a solution container having a projecting pierceable closure comprising:

a collapsible medicament container for storing the medicament to be transferred with a pierceable stopper sealing said medicament in said medicament container;

a closure member secured to said medicament container and in contact with a portion of said pierceable stopper, said closure member presenting a passage therethrough;

a holder member having secured thereto a piercing member with a channel therethrough for the flow of said medicament and a piercing point on both ends, said holder member defining guide means for surrounding said projecting pierceable closure and terminating inwardly of one end of said piercing member; and a cover member adapted to extend over said holder member, said holder and cover members and said medicament container defining together means to effect movement of said holder member and said other end of said piercing member through said passage and toward said medicament container, so that one of said piercing points of said piercing member will pierce said pierceable stopper and provide a passage for flow of said medicament from said medicament container to said solution container when said other of said piercing points penetrates said projecting pierceable closure of said solution container.

10. The readily activated transfer device of claim 9 wherein said means to effect movement of said holder member toward said medicament container is defined by a complementary threaded engagement carried by said medicament container and said holder.

11. The readily activated transfer device of claim 10 wherein said medicament container includes a neck portion and said complementary threaded engagement is carried in part by said neck portion.

12. The readily activated transfer device of claim 11 wherein said closure member is defined by a cap member operatively associated with said neck portion and said threaded engagement carried by said neck portion is defined by said cap member.

13. The additive transfer device as defined in claim 12 wherein said pierceable stopper sealing element is defined by a disc member captively held between said container cap member and the outer end of said neck portion.

14. The additive transfer device as defined by claim 13 wherein said collapsible container is defined by a multiplicity of collapsible wall portions connected in a serial manner.

* * * * *